United States Patent [19]

Raymond et al.

[11] Patent Number: 4,555,885

[45] Date of Patent: Dec. 3, 1985

[54] FILLER STRIP WITH LOCKING CLIP

[75] Inventors: Ronald P. Raymond, Chagrin Falls; William C. Andrick, Uniontown, both of Ohio

[73] Assignee: Polymer/Raymond Industries, Inc., Middlefield, Ohio

[21] Appl. No.: 491,862

[22] Filed: May 5, 1983

[51] Int. Cl.[4] ..... E04C 1/34

[52] U.S. Cl. ..... 52/468; 52/288; 52/718.1

[58] Field of Search ..... 52/543, 544, 464, 468, 52/470, 471, 472, 273, 287, 288, 278, 290, 396, 242, 466, 469, 511, 512, 717, 718, 403, 573; 404/35, 36, 40

[56] References Cited

U.S. PATENT DOCUMENTS

| | | | |
|---|---|---|---|
| 3,007,213 | 11/1961 | Hobbs | 52/288 |
| 3,435,574 | 4/1969 | Hallock | 52/278 |
| 3,659,390 | 5/1972 | Balzer et al. | 52/396 |
| 3,667,177 | 6/1972 | Biela | 52/287 |
| 3,688,460 | 9/1972 | Van Loghem et al. | 52/468 |
| 4,067,155 | 1/1978 | Ruff et al. | 52/468 |
| 4,337,604 | 7/1982 | Burgers | 52/287 |

*Primary Examiner*—John E. Murtagh
*Assistant Examiner*—Andrew Joseph Rudy
*Attorney, Agent, or Firm*—Fay, Sharpe, Fagan, Minnich & McKee

[57] ABSTRACT

A resilient, pressure-locking filler strip is provided for closing a gap or joint of a wall panel assembly. The filler strip has a flange portion for enclosing the gap and a pressure-locking clip for compressive retention in the gap. The clip is selectively cooperable with the flange portion for ready interchange of a plurality of different size clips for retention in a plurality of different size gaps. The clip includes first and second opposed gripping portions for compressive engagement to associated side wall portions of the gap. In one embodiment the flange portion comprises a first flange and a second flange depending normally away from the first flange for enclosing a gap or joint at a wall corner. In another embodiment the flange portion comprises a first flange and a second flange coplanar with the first flange for enclosing a gap in a flat wall section of the wall assembly. Preferably, the pressure-locking filler strip is a plastic extrusion.

15 Claims, 8 Drawing Figures

FILLER STRIP WITH LOCKING CLIP

BACKGROUND OF THE INVENTION

This invention pertains to the art of modular building panel or wall assemblies and more particularly to filler strips employed for closing gaps or joints between modular panels of such assemblies.

The invention is particularly applicable to a filler strip for closing a gap in a wall comprised of modular panels wherein the panels are pre-engineered and prefabricated for on-cite assembly and typically include gaps or joint spaces between adjacent panels after assembly. The panels may be constructed of a variety of building materials but typically concrete or various other heavy and rigid building materials are employed. The filler strip encloses and generally seals the joint spaces resulting when the panels are not in sealing abutment. It will be appreciated by those skilled in the art, however, that the invention could be readily adapted for other uses, as, for example, where similar filler strip devices are employed.

Conventional modular building panel assemblies which are assembled on cite typically suffer from the problems of having joint spaces or gaps of a variety of widths between adjacent panels of a flat wall section assembly and at corners of the wall assembly. Prior filler strips which have been employed for closing these gaps have suffered from the problems of not being readily adjustable for accommodating gaps of various dimensions to close the gaps. In addition, such filler strips were cumbersome and difficult to install. Where prior filler strips irregularly engaged the side walls of the modular panels, not only did problems arise from inadequate closure of the gap but also a displeasing aesthetic appearance was presented.

It has long been sought to provide a simple and inexpensive means to close a gap between modular panels where a plurality of gaps may comprise a variety of dimensions in a singular modular panel assembly. The present invention contemplates a new and improved filler strip with locking clip which overcomes all of the above-referred to problems and others to provide a new filler strip which is simple in design, economical to manufacture, readily adaptable to a plurality of closure applications with panel members having a variety of dimensional characteristics and which provides improved gap closure and aesthetic appearance.

BRIEF SUMMARY OF THE INVENTION

In accordance with the present invention, there is provided a resilient, pressure-locking filler strip for closing a gap between modular panels of a pre-engineered and pre-fabricated modular building panel assembly. The filler strip has a flange portion for enclosing the gap and a pressure-locking clip for compressive retention in the gap. The clip is selectively cooperable with the flange portion for ready interchange of a plurality of different size clips for association with a plurality of different size gaps. The clip includes first and second opposed gripping portions for compressive engagement to associated side wall portions of the gap.

In accordance with another aspect of the present invention, the clip is slideably received in an extended receiving slot of the strip flange portion. The clip has a base portion sized for close reception in the receiving slot for obstructing rotational movement of the clip away from the strip flange portion.

According to a further aspect of the invention, the strip flange portion and the pressure-locking clip comprise plastic extrusions.

In accordance with yet another aspect of the present invention, the strip flange portion includes a first flange and a second flange depending normally away from the first flange. The first and second flanges comprise a strip flange portion configured for enclosing a gap at a wall corner.

In accordance with the present invention, there is provided a filler strip for closing a gap in a wall comprising a first flange sized for overlapping engagement to a first contiguous shoulder of the wall, a second flange sized for overlapping engagement to a second contiguous shoulder of the wall, an intermediate protuberance depending from the first and second flanges and including first means for gripping the wall, a removable locking pressure clip including second means for gripping the wall opposite of the first means and an extended receiving slot for receiving the clip whereby upon compressive retention of the clip and the protuberance in the gap the filler strip closes the gap.

One benefit obtained by use of the present invention is a filler strip including a locking pressure clip which is adjustable for locking the filler strip in a variety of dimension gaps or joint spaces between modular wall panels of a wall panel assembly.

Another benefit obtained from the invention is a filler strip including an extended receiving slot for the locking clip from which the clip may be readily removed and an alternate size locking clip may be readily inserted, sized for locking association with the gap to be enclosed.

A further benefit of the present invention is a filler strip which provides improved ease of installation for flush engagement against the side walls of adjacent modular panels of a modular building panel assembly.

Other benefits and advantages for the subject new filler strip with locking clip will become apparent to those skilled in the art upon a reading and understanding of this specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE INVENTION

Figure 1:
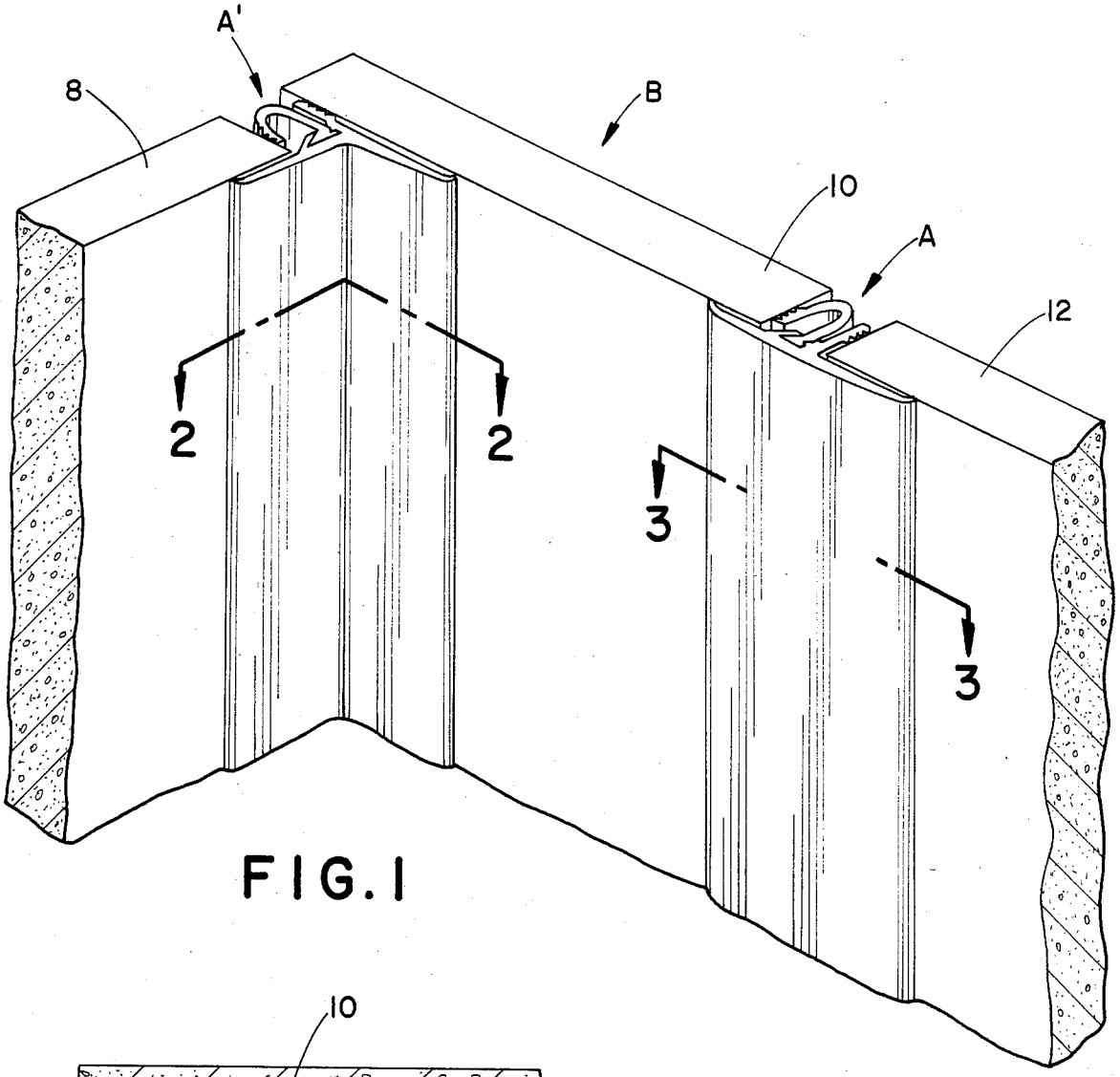
FIG. 1 is a generally perspective view of a modular building panel assembly including filler strips formed in accordance with the present invention for closing joint spaces between modular panels of the assembly.

Referring now to the drawings wherein the showings are for purposes of illustrating the preferred and alternative embodiments of the invention only and not for purposes of limiting same, the FIGURES show a filler strip A for closing a gap or joint space in a wall of a building panel assembly B and an alternative embodiment of a filler strip A' for closing a gap at a corner of the building panel assembly. Where alternative embodiments of the invention are shown, like components are identified by like numerals with the addition of a primed (') suffix and new components are identified by new numerals.

Figure 3:
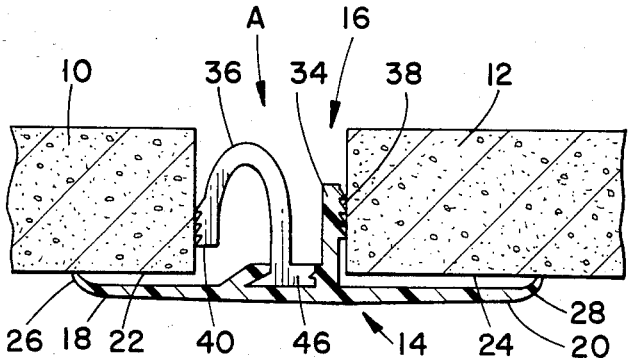
FIG. 3 is an enlarged cross-sectional view taken along line 3—3 of FIG. 1.
Figure 5:
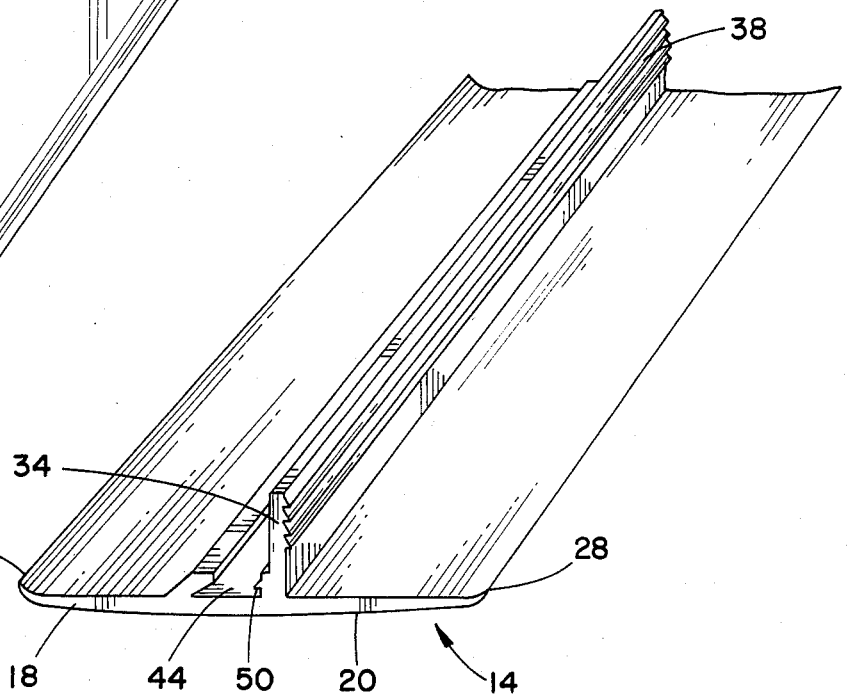
FIG. 5 is a generally perspective view of a portion of a filler strip formed in accordance with the present invention for closing a gap in a side wall such as may typically be included between adjacent panels of a flat wall section of a modular building panel assembly.

More specifically, and with reference to FIGS. 1, 3 and 5, filler strip A is useful for closing a gap between opposed panels 10,12 of the building panel assembly B. Filler strip A is preferably constructed of a resilient durable material such as a plastic; however, it is within the scope of the invention to include alternate construction materials such as resilient metals or the like. Extrusion manufacture of the filler strip A has been found to be particularly advantageous so it is further preferable to employ a construction material that is susceptible to extrusion for manufacture of the filler strip.

The filler strip A is chiefly comprised of a strip flange portion 14 and a pressure-locking clip 16. The strip flange portion 14 is preferably of unitary construction and encloses the gap. It includes a first flange 18 and a generally coplanar second flange 20 sized for overlapping engagement to a first contiguous shoulder 22 of wall or panel member 10 and a second contiguous shoulder 24 of wall or panel 12, respectively. The terminal end portions of flanges 18 and 20 comprise arcuate lips 26,28 respectively, which abut the wall shoulders 22,24 and provide a space between the flanges 18,20 and the surfaces of the wall shoulders 22,24. The combination of the space and resilient qualities of the flanges 18,20 accommodate surface irregularities in the panels 10,12 to maintain engagement along the entire extent of the filler strip at the flange lips 26,28.

Pressure locking clip 16 includes a protuberance 34 intermediate of flanges 18,20 and an arcuate clip 36 opposite of the protuberance 34. Protuberance 34 includes a means for gripping the wall of panel member 12 which preferably comprises a plurality of teeth 38 integrally formed in the protuberance 34. Similarly, arcuate clip 36 includes a second means for gripping the panel 10 at wall gap shoulders, preferably comprising a plurality of teeth 40 which are urged against the panel member 10 by the natural resiliency of the clip 36 in compressive retention between the panel members 10,12.

It is a particular feature of the invention that arcuate clip 36 is sized for ready insertion and removal from a receiving slot 44 (FIG. 5) formed in the strip flange portion 14. Slot 44 is configured such that a base portion 46 of arcuate clip 36 may only be inserted in the proper manner to direct clip teeth 40 in a direction opposite of protuberance teeth 38. In addition, slot 44 includes a base wall comprising the first flange 18, a first side wall 48 protruding from the first flange 18 and a second side wall comprising the intermediate protuberance 34. The first side wall 48 is angularly disposed toward the second side wall to obstruct rotational movement of the arcuate clip 36 away from the base wall or first flange 18 upon reception of the clip in the slot 44 or ultimately upon compressive retention of the pressure-locking clip in a wall gap. The second side wall includes a retaining lip 50 received in a mating groove 52 (FIG. 6) to obstruct opposite rotational movement away from the base wall and protuberance 34 upon reception of the clip in the slot. The gripping portion 40 of the arcuate clip 36 which includes the clip teeth is arcuately formed to allow for deflection of clip 36 upon insertion of the filler strip into a wall gap. Similarly, protuberance 34 may deflect accordingly. The resilient deflection and compressive retention of the pressure-locking clip 16 operates to fasten the filler strip A in the wall gap.

Figure 2:
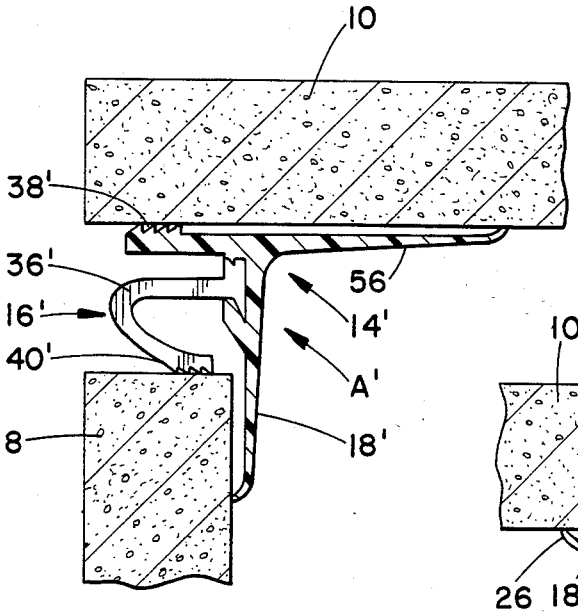
FIG. 2 is an enlarged cross-sectional view taken along line 2—2 of FIG. 1.
Figure 4:
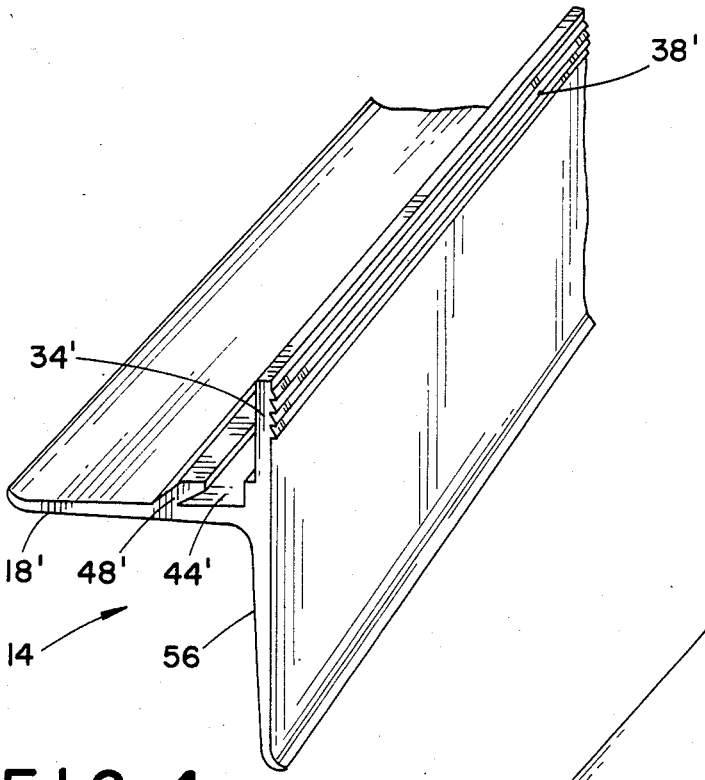
FIG. 4 is a generally perspective view of a portion of a filler strip formed in accordance with the present invention for closing a gap at a wall corner.

With particular reference to FIGS. 1, 2 and 4, an alternative embodiment of a filler strip A' for closing a gap at a corner of a building panel assembly is illustrated. The pressure-locking clip 16' is substantially identical to the pressure-locking clip 16 of filler strip A and includes a protuberance 34' including a gripping portion of teeth 38' at an end portion of the protuberance and an arcuate clip 36' including a gripping portion of teeth 40' generally opposite of the teeth 38' of the protuberance. The strip flange portion 14' includes a first flange 18' and a second flange 56 normally depending from the first flange for overlapping engagement of panel member 10. First flange 18' overlaps panel member 8 which is normally directed from panel member 10.

Figure 6:
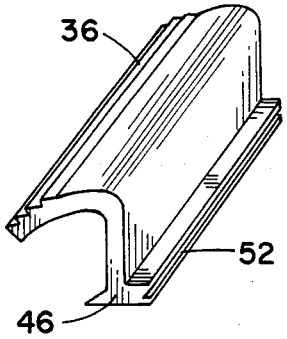
FIG. 6 is a generally perspective view of one embodiment of a pressure-locking clip formed in accordance with the present invention.
Figure 7:
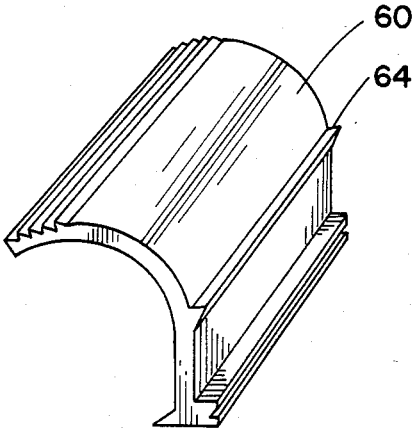
FIG. 7 is a generally perspective view of an alternative pressure-locking clip formed in accordance with the present invention for retention in an alternate size gap; and, FIG. 8 is a generally perspective view of yet another embodiment of a pressure-locking clip for retention in another alternate size gap.
Figure 8:
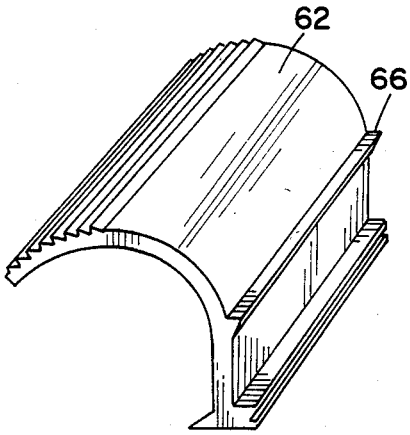

With particular reference to FIGS. 6, 7 and 8, it is within the scope of the invention to employ a plurality of different sized arcuate clips 36,60,62 for use with a strip flange portion 14, 14' depending upon the size of a gap to be filled and enclosed. For larger size arcuate clips 60,62, it has been found to be advantageous to include a bracing rim 64, 66 which braces clip 60,62 against the protuberance of the strip flange portion.

In installation of the invention, it is first necessary to measure the dimension of a gap or joint space to be filled from top to bottom. After gap width is determined, a selection of the proper arcuate clip is made and the clip base portion 46 is inserted into the receiving slot 44 of the strip flange portion 14. Preferably, the clips are spaced on 300 mm centers and a clip should be included at the top and bottom of the filler strip. Locater marks (not shown) are included on the strip flange portion for convenience in locating the 300 mm centers. For insertion into the panel or wall gap an installer will begin at the bottom of the gap and force the filler strip flush against the wall, thereby forcing the pressure-locking clip 16 into the gap. Tight gaps or joints may require the use of a mallet and wood block to drive the strip flush. When the sides of the filler strip are flush with the wall panel members, the filler strip is installed and the wall panel gap is enclosed.

The invention has been described with reference to the preferred and alternative embodiments. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. A filler strip in combination with a wall having a gap for closing the gap, said filler strip comprising:

a first flange sized for overlapping engagement to a first contiguous shoulder of the wall;

a second flange sized for overlapping engagement to a second contiguous shoulder of the wall;

an intermediate protuberance integrally formed with said flanges, depending from said first and said second flanges and including first means for gripping engagement to the wall;

a selectively insertable locking pressure clip including second means for gripping a wall gap shoulder opposite of said first means; and, an extended receiving slot for selectively receiving said clip;

said protuberance and locking pressure clip being sized for compressive deflection and retention in said gap by engagement to the wall gap shoulders, and said protuberance and locking clip being received in the gap to an extent defined by generally flush engagement of said flanges to said wall whereby upon the compressive retention of said clip and said protuberance in said gap said filler strip closes said gap.

2. The filler strip as defined in claim 1 wherein said receiving slot is integrally formed with said intermediate protuberance and at least one of said flanges.

3. The filler strip as defined in claim 1 wherein said flanges, said protuberance, said pressure clip and said receiving slot comprise extrusions.

4. The filler strip as defined in claim 1 wherein said receiving slot includes a base wall comprising said first flange, a first side wall protruding from said first flange and a second side wall comprising said intermediate protuberance.

5. The filler strip as defined in claim 4 wherein said first side wall is angularly disposed towards said second side wall to obstruct rotational movement of said pressure clip away from said base wall upon reception of said clip in said slot.

6. The filler strip as defined in claim 4 wherein said second side wall includes a retaining lip to obstruct rotational movement away from said base wall upon reception of said clip in said slot.

7. The filler strip as defined in claim 1 wherein said locking pressure clip includes a base portion for reception in said receiving slot and a gripping portion including said second means for gripping.

8. The filler strip as defined in claim 7 wherein said base portion is configured for close reception in said receiving slot and includes a first side wall angularly disposed towards said intermediate protuberance to obstruct rotational movement of said base portion away from said receiving slot.

9. The filler strip as defined in claim 8 wherein said base portion includes a second side wall including a receiving trough for nesting reception of a retaining lip to obstruct rotational movement of said base portion from said receiving slot.

10. The filler strip as defined in claim 7 wherein said gripping portion is arcuately configured and includes said second means for gripping at an end portion.

11. The filler strip as defined in claim 10 wherein said gripping portion is configured for resilient deflection and compressive retention in said gap whereby said second gripping means is positioned generally opposite of said first gripping means for engagement of a side wall of said gap.

12. The filler strip as defined in claim 1 wherein said first means for gripping the wall is disposed at an end portion of said intermediate protuberance generally opposite of said second means for gripping.

13. A resilient, pressure-locking filler strip for closing a gap in a wall having a strip flange portion for enclosing the gap and a selectively associable pressure-locking clip for compressive retention in the gap, said clip being removably fastened to said flange portion for ready interchange of a plurality of different sized clips for association with a plurality of different sized gaps and including first and second opposed gripping portions for compressive engagement to associated side wall portions of said gap, said clip being received in the gap to an extent defined by generally flush overlapping engagement of said flange portion to the wall, said clip further being slideably received in an extended receiving slot of said strip flange portion and having a base portion sized for close reception in said receiving slot for obstruction of rotational movement away from said strip flange portion.

14. The filler strip as defined in claim 13 wherein said strip flange portion and said pressure-locking clip comprise plastic extrusions.

15. The filler strip as defined in claim 13 wherein said strip flange portion includes a first flange and a second flange depending normally away from said first flange, said first and second flanges comprising a strip flange portion for enclosing a gap at a wall corner.

* * * * *